US005130953A

United States Patent [19]

Grosso

[11] Patent Number: 5,130,953

[45] Date of Patent: Jul. 14, 1992

[54] SUBMERSIBLE ELECTRO-ACOUSTIC TRANSDUCER

[76] Inventor: Gilles Grosso, 58, Boucle de la Malogineste, 83140 - Six Fours Les Plages, France

[21] Appl. No.: 712,947

[22] Filed: Jun. 10, 1991

[51] Int. Cl.[5] ..... H04R 17/00

[52] U.S. Cl. ..... 367/155; 367/156; 367/159; 367/158; 367/163; 310/334; 310/337; 29/594

[58] Field of Search ..... 367/159, 155, 156, 158, 367/163, 168; 310/337, 334; 29/594, 25.35

[56] References Cited

U.S. PATENT DOCUMENTS 3,110,825 10/1963 Miller ..... 367/157
3,263,210 7/1966 Schloss ..... 367/157
3,277,436 10/1966 Fitzgerald et al. ..... 367/159
4,072,871 2/1978 Wilson ..... 310/333

FOREIGN PATENT DOCUMENTS 0367681 9/1990 European Pat. Off. .

*Primary Examiner*—J. W. Eldred
*Attorney, Agent, or Firm*—Ladas & Parry

[57] ABSTRACT

An electro-acoustic transducer comprises two transducer units each having first and second ends, a tubular supporting member disposed between the two transducer units, and a pair of oppositely disposed supporting components between which the transducer units and tubular member are disposed. One of the transducer units is compressively clamped between one of the supporting components and one end of the tubular member, and the other of the transducer elements is compressively clamped between the other of the supporting components and the other end of the tubular member.

15 Claims, 6 Drawing Sheets

SUBMERSIBLE ELECTRO-ACOUSTIC TRANSDUCER

This invention concerns a submersible electro-acoustic transducer and a manufacturing process for this electro-acoustic transducer.

Electro-acoustic transducers are commonly used, especially for emitting signals intended for communications and for submarine detection.

The most widely used electro-acoustic transducers consist of a motor, or active part, which generally consists of a stack of piezo-electric ceramics alternating with electrodes, the whole forming an elongated cylinder. When a voltage is applied to the ceramics, they deform. The ceramics are arranged and wired so that their deformations are cumulative, so that longitudinal movements of contraction and expansion of the piezo-electric ceramic stack are produced. This stack is connected at one of its ends to a support, usually of metal, which is often called the counter-support or counter-weight and which is maintained practically motionless with regard to the transducer casing. At the other end, the stack is connected to another mass, sometimes called the cone, which vibrates along the longitudinal axis of the stack, because of the movements induced in this by the voltage applied to the ceramics.

This cone is in contact with the desired propagation medium, which is usually water, generally with an intervening elastic covering which provides waterproofing for the transducer.

Technical and technological progress in this field has led to the production of several types of relatively standard mechanical assemblies for electro-acoustic transducers, and particularly the following three types.

Electro-acoustic transducers of the "TONPILZ" type, including the basic mechanical assembly briefly described above, which consist of a counter-weight fixed in a cylindrical casing by means of suspensions which restrict the movements between the waterproof casing and this counterweight and a stack of piezo-electric ceramics which cause the cone to vibrate.

The stack is pre-stressed axially along its longitudinal axis, by a system usually made up of a rod passing through the stack and screwed into the cone, which is attached to the counter-weight by a nut and is subjected to stress.

Electro-acoustic transducers of the "JANUS" type are similar to two "TONPILZ" type electro-acoustic transducers, with a shared counter-weight and whose stacks vibrate in counter-phase.

Electro-acoustic transducers of the "FLEXTENSIONAL" type use a slightly different principle of pre-stressing and of transmitting the vibrations to the propagation medium. In this type of electro-acoustic transducer, for example in class 4 "FLEXTENSIONAL" transducers, the casing consists of an elliptical cross-section, cylindrical shaped shell, usually of epoxy-glass fibre composite, which because of its elasticity tends to either flatten out or become more rounded. Within this shell, one or more pairs of piezo-electric ceramic stacks are arranged symmetrically around a central core extending along the cylindrical axis of the shell. The stacks are supported at one end by metal inserts extending parallel to the central core and which are connected to the inside of the shell near the extremity of the long axis of the ellipse forming the cross-section of shell.

The assembly consisting of the stacks and central counterweight is fitted into the shell, which is pre-stressed by being compressed along the small axis of the ellipse. When the assembly is in place inside the shell, the pre-stressing is released and the long axis of the ellipse shortens, which pre-stresses the assembly along the longitudinal axis of the stacks.

Although the most widely used transducer components are stacks of piezo-electric ceramics, these ceramic stacks can, in certain cases, be replaced by magnetostrictive transducers. These transducers consist mainly of an elongated bar usually made up of material consisting mainly of rare earth elements, which can vibrate and contract and expand along the longitudinal axis under the effect of a magnetic field created by a coil wound round the bar.

The present uses of electro-acoustic transducers have led to research on methods of increasing their power and of enabling them to emit at lower and lower frequencies.

In the case of electro-acoustic transducers made of stacks of piezo-electric ceramics, it is known that the power is roughly proportional to the volume of ceramic put into the electro-acoustic transducer and that the lower limit of frequencies likely to be emitted is related to the intrinsic frequency of longitudinal compression of the ceramic stack. In order to produce a high power electro-acoustic transducer capable of emitting the lowest possible frequency, it is therefore necessary to make a stack forming a very long cylinder.

Such a principle is obviously confronted with technological and especially economic limits. It therefore often necessary to make numerous electro-acoustic transducers which are assembled into an antenna, also known as a network, which complicates the mechanical assembly and electrical wiring of the unit and increases costs.

The problem posed is therefore to obtain electro-acoustic transducers capable of being submerged and which will supply increased power and/or be capable of emitting at relatively low frequencies, without significantly increasing their volumes, and to invent methods for their manufacture.

According to the invention, a solution to the problem posed is to produce an electro-acoustic transducer within a casing, consisting of at least one supporting component or cone and at least one other supporting component, or counter-weight, and consisting of at least two transducer units elongated along the longitudinal axis of said transducer, and bearing at least one pre-stressed rod along said longitudinal axis, between said first and second supporting components of said transducer units, such that the transducer units are arranged side by side, and/or comprise a coaxial cylinder having as axis said longitudinal axis, and which can vibrate in phase, and such that it contains at least one rigid intermediate component or unit, which is movable and which is mounted or stacked between said transducer units, in mechanical series with said transducer units, such that said rigid intermediate component can be pre-stressed using said rod, at the same time as said transducer units, and such that said rigid intermediate component is likely to vibrate in phase with said transducer units.

In addition, an electro-acoustic transducer according to the invention contains at least two transducer units of elongated shape along a longitudinal axis, situated between first and second pre-stressed supporting components along said longitudinal axis using a pre-stressing device, which tends to pull the two supporting components together, said transducer units each having two longitudinal ends which are parallel and flat, said transducer units are parallel, side by side and function in phase, the assembly being contained in a casing, and only one end of one of said transducer units is in contact with said first supporting component, and only one end of the second transducer unit is in contact with said second supporting component, and said transducer contains a rigid intermediate assembly which is fitted between said first and second transducer units, which has two parallel faces which are in contact respectively with the two ends of said transducer units and which can be pre-stressed along said longitudinal axis at the same time as said first and second transducer units, by said pre-stressing device; each of said transducer units can be made of either at least one magnetostrictive bar, or of at least one stack of piezoelectric ceramics, alternating with electrodes forming an elongated shaped cylinder.

In an electro-acoustic transducer according to the invention, longitudinal gaps are also foreseen between said rigid intermediate component and said first and second supporting components, respectively, such that when there is a relative displacement between said supporting components due to the forces produced by said transducer units and the forces due to said pre-stressing device, contact between said rigid intermediate component and said supporting components is avoided.

In addition, in an electro-acoustic transducer according to the invention, said rigid intermediate unit is made up of a single rigid piece of metal, which can for example form a roughly cylindrical component, with an axis parallel to said longitudinal axis, and ending at one extremity by hollow which bears one of said two parallel faces, which is in contact with the second end of one first of said transducer units, and on its other extremity, by an external collar which is in contact with the other of said two parallel faces, and which is in contact with the second end of the second of said transducer units.

In the preferred form of construction, said intermediate unit consists of at least two rigid intermediate components and at least one intermediate transducer unit which is fitted between said two rigid intermediate components and arranged in mechanical series with these.

In the preferred form of construction of the electro-acoustic transducers according to the invention, said pre-stressing device consists of one or more rods, which are fixed by each of their ends to each of said supporting components, or to an intermediate component, notably for application to the "TONPILZ" and "JANUS" type assemblies, or else consists of said deformable casing, notably for application to the "FLEXTENSIONAL" type assemblies.

In one particular form of construction according to the invention, the transverse section of the active parts of said first and second transducer units are roughly equal.

One solution to the problem posed is also to obtain a manufacturing process for electro-acoustic transducers of the type consisting of at least one elongated shaped transducer unit, which is axially pre-stressed between two supporting components, characterised by mounting a first elongated transducer unit between said supporting components, with only one end in contact with one of the two supporting components and a second elongated transducer unit, with only one end in contact with the other supporting component, said transducer units being parallel and side-by-side and functioning in phase; an intermediate component is fitted between the two transducer units, this component resting on one of the two ends of said transducer units, and the two transducer units are pre-stressed between the two supporting components and said intermediate component which transmits the longitudinal forces between the two transducer units.

The advantages provided by the electro-acoustic transducers according to the invention are numerous.

For example, in a electro-acoustic transducer according to the invention, the fitting in of a second stack of ceramics in the form of a ring practically encircling the first stack, the two stacks having the same height and the active components having practically the same section, produces an electro-acoustic transducer whose power is practically doubled in comparison with known electro-acoustic transducers of the same volume, which only contain the first said stack, since the volume of ceramic is doubled and at the same time the equivalent length of the imaginary stack thus formed by the two interposed stacks is doubled; as a result the resonant frequency of the interposed stack in the invention, which is roughly inversely proportional to the square root of the length, will be decreased by 40% compared to an electro-acoustic transducer of known design of the same dimensions.

In addition, the assembly according to the invention can be used to fit together more than two stacks, without significantly increasing the dimensions of the transducer, enabling even greater performances in terms of power and/or low frequencies to be obtained.

The reliability of the compound assemblies according to the invention is significantly improved and the cost of the assemblies significantly decreased.

Electro-acoustic transducers according to the invention can be constructed either with piezo-electric ceramic transducers or with magnetostrictive bars.

The numerous advantages and characteristics of the invention are clearly shown in the attached figures which represent, in a non-exhaustive way, the methods of producing electro-acoustic transducers according to the invention, and their methods of manufacture.

FIG. 1 represents an electro-acoustic transducer according to the invention which is equipped with two transducer units made up of piezo-electric ceramics, in a "TONPILZ" type assembly.

Figure 1:
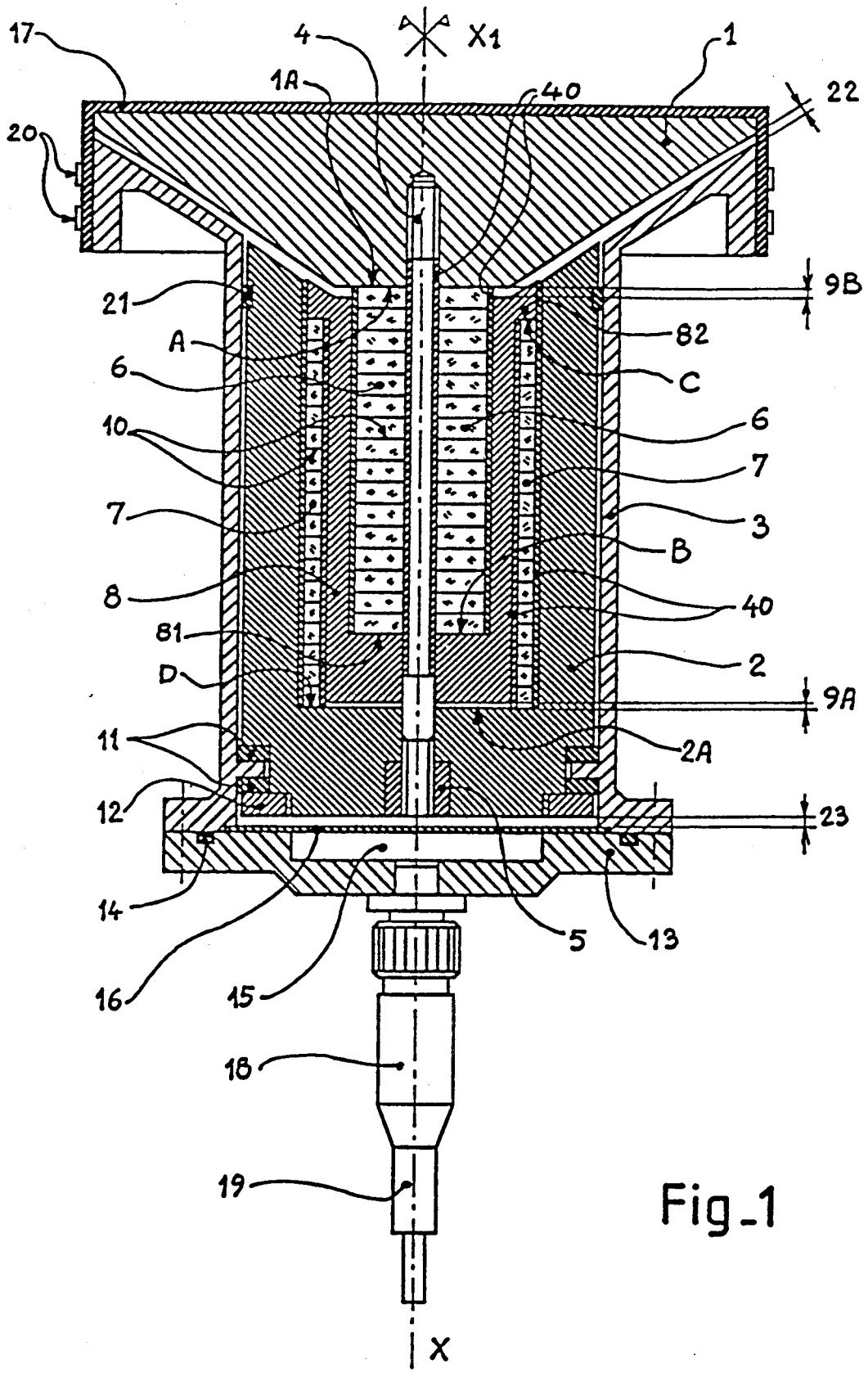
FIG. 1 represents a transverse section at reduced scale of a method of constructing an electro-acoustic transducer of the "TONPILZ" type assembly, according to the invention.

The electro-acoustic transducer in this type of assembly consists of a metal casing 3, a counter-weight 2, a cone 1, a pre-stressed rod 4 and a locking nut 5, all of known type.

It can be seen that said casing 3 is closed at one end by a lid 13 which is waterproofed by a sealing ring 14.

Said counter weight, which forms a supporting component, is fitted to the inside of said casing by means of suspension units 11 which rest on an internal rim of said casing and by means of a suspension nut 12; said counter-weight is maintained centred in said casing by means of centering ring 21.

A sealed connector 18 is attached to said lid 13 and is linked to an electric cable 19 which supplies the electrical energy required to power said piezo-electric ceramics.

An insulating disc 16 is fitted between said casing and said lid and encloses a cavity 15 between it and the lid in which are fitted the electric wires which provide the connection between said connector and said transducer units.

Said cone 1, which forms the second supporting component, is usually provided with an elastic covering 17, which can be vulcanised onto said cone and which is tightened onto one end of said casing by collars 20 providing waterproofing for said electro-acoustic transducer.

It can be seen that said electro-acoustic transducer consists of, in a known manner, a first stack of piezo-electric ceramics 6 in the form of discs alternating with electrodes 10, so as to produce an elongated cylinder along a longitudinal axis xxl, which in this type of construction is the same as the axis of said electro-acoustic transducer.

Said pre-stressed rod is anchored to said cone by screwing one of its threaded ends into a machine-threaded hole in said cone.

It can be seen that in accordance with the invention, said electro-acoustic transducers include a second stack of piezo-electric ceramics 7 in the form of a ring and alternating with electrodes 10, so as to form a second elongated cylinder along said axis xxl, and that said electro-acoustic transducer bears a rigid intermediate component 8, which is fitted between said first and second piezo-electric ceramic stacks, said rigid intermediate component 8 making up said rigid intermediate unit in this type of construction according to the invention.

In known electro-acoustic transducers, said stacks rest with one of their longitudinal ends on one of said supporting components (cone) and the other longitudinal end on the other supporting component (counter-weight). In an electro-acoustic transducer according to the invention, only the first end of the first of said transducer units rests against the first supporting component and only the first end of the second said transducer units rests against the second supporting component, and the transducer includes a rigid intermediate unit fitted between said first and second transducer units, and which has two parallel faces which rest against the second ends of said transducer elements, and which can be pre-stressed together with said first and second transducer units, along said longitudinal axis (xxl) by said pre-stressing device.

More precisely in the particular method of construction according to the invention, the contact face 1A of said cone 1 is opposite the first contact face A of said first ceramic stack 6, the second contact face B of said first stack is opposite the first contact face 81, situated at the base of said rigid intermediate component 8, the second contact face 82 situated on the external collar of said rigid intermediate component 8 is opposite the first contact face C of said second ceramic stack 7, the second contact face D of said second ceramic stack 7 is opposite the contact face 2A situated on said counter-weight.

According to the invention, during assembly of said electro-acoustic transducer, said pre-stressing rod is screwed onto said cone and fixed, said first stack is fitted around said rod so that it comes in contact with said cone, said rigid intermediate component is fitted around said rod and around said first ceramic assembly 6, so that it comes in contact with the first stack by its face 81, the second ceramic stack 7 is fitted around said rod and said rigid intermediate component so that it comes in contact with said collar of said rigid intermediate component by its contact face C, and finally said counter-weight is fitted around said rod and said stack so that it comes in contact by its face 2A with face D of said second stack.

Said counter-weight is then held and traction is applied to said rod, along its longitudinal axis and in a direction away from said cone; said traction thus tends to displace said cone towards the counter-weight, and by means of the contact faces opposite one another, said traction causes a compressional pre-stressing along said axis xxl of the first stack between the contact faces 1A and 81 of said cone and said rigid intermediate component respectively, said traction causes a compressional pre-stressing along said axis xxl of said second stack between the contact faces 82 and 2A of said rigid intermediate rigid component and said counter-weight respectively, along said axis xxl of said rigid intermediate component.

Then, while maintaining said traction, said nut 5 is screwed onto the second screw threaded end of said rod, in a known manner, until it comes into contact with said counterweight, then said traction is released, the nut now holding the assembly under pre-stress.

The assembly thus formed can be mounted in said casing, and the final assembly operations can be carried out.

It is evident that very high quality parallelism must be obtained between the contact faces of these components, particularly between said contact faces 81 and 82 of said rigid intermediate component.

It can be seen that in an electro-acoustic transducer according to the invention, a gap 9A must be allowed between said counter-weight 2 and said rigid intermediate component 8, along the longitudinal axis xxl. Another gap 9B must be allowed for between said rigid intermediate component 8 and said cone 1, so that during the vibratory movements of said cone and said rigid intermediate component, caused by the movements of contraction and expansion of said first and second stacks, contact between said rigid intermediate component, said cone and said counter-weight is avoided. The size of these gaps should preferably be of the order of a few millimetres.

In this document, in the expressions—rigid intermediate unit—and—rigid intermediate component—, the rigidity in question is the longitudinal rigidity of said component or said unit, that is to say the rigidity against forces of traction or compression along said longitudinal axis xx1; it is evident that in addition the rigidity (or stiffness) of said intermediate component or said intermediate unit, must be sufficient along all other axes not parallel to xx1 to ensure its correct mechanical behaviour; said longitudinal rigidity of said intermediate component or said intermediate unit will in the majority of cases be significantly greater than the longitudinal rigidity of said first and second stacks.

It should be noted that said rod 4, said first stack, said intermediate component and said second stack should by preference be sheathed by insulating sleeves 40, of roughly cylindrical shape; these sleeves serve to provide electrical insulation between the various components; they also help to minimise the rubbing that could occur between the components due to their relative vibratory movements.

Passages (not figured) are of course planned in the various components to allow the electrical wires (not figured) to be threaded through from said cavity 15 to said electrodes of said stacks.

It is evident that the electric wiring of said first and second stacks is such that the respective longitudinal vibrations of said stacks are at all times cumulative, so that their amplitudes are cumulative, and that the power of said electro-acoustic transducers is therefore roughly equal to the sum of the powers of said first and second stacks.

It can be seen in the figure that said electro-acoustic transducer contains, in a known manner, gaps 22 and 23 which correspond to the spaces allowed for between, firstly said casing and said cone and secondly between said casing and said counter-weight; these spaces are generally filled with gas.

Figure 2:
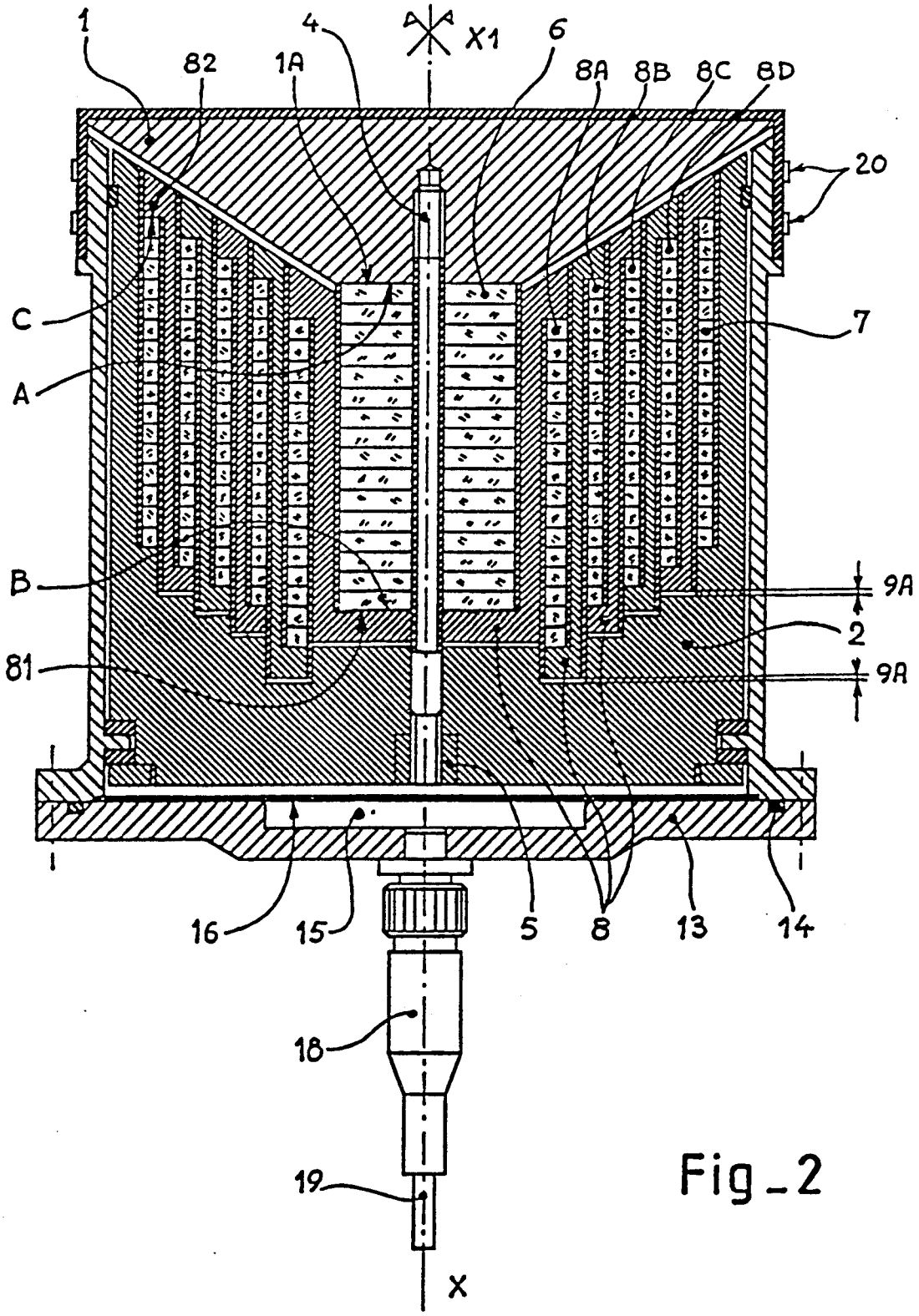
FIG. 2 represents a transverse section at reduced scale of another method of construction.

A transverse section of another means of constructing an electro-acoustic transducer according to the invention is shown in FIG. 2, in the form of a "TONPILZ" type assembly.

Those working components that are identical to those in FIG. 1 are identified by the same numbers.

It can be seen on the figure that in this particular form of construction according to the invention, said cone is in contact by a contact face 1A with the first end A of said first stack 6 of disc-shaped ceramics, that said first stack is in contact by its second end B with the face 81 of said rigid intermediate unit, said rigid intermediate unit being in contact by its face 82 with the first contact face C of the second ceramic stack 7, which can be in the form of a ring; nevertheless because of the relatively large diameter of this ring, said ceramics 7 could advantageously be in the form of sectors of a ring, in order for example to obtain a cross-section of active parts—the ceramics—of said second stack that is roughly equal to the cross-sectional area of said first stack. The choice of forms and dimensions are made in relation to the performances required of the transducer.

It can be seen on this figure, that in accordance with the invention, said rigid intermediate unit which transmits the pre-stressing compressional forces exercised by said rod 4 between said first and second stacks, is made by assembling five rigid intermediate components 8, and four intervening stacks 8A, 8B, 8C, and 8D of piezo-electric ceramics, which can be in the form of a ring or in sectors.

According to the invention, said first and second stacks and said intermediate stacks are connected such that the vibratory movements of said stacks are in phase.

It can be seen that said intermediate components are cylindrical in form, their axis being said longitudinal axis xx1, and they are each provided with an internal collar at one end and an external collar at the other end, these collars being each provided with a contact face, the two contact faces of each of said rigid intermediate components being parallel and at right angles to said longitudinal axis xx1.

Gaps 9A are allowed for between each rigid intermediate component which is liable to vibrate and said counter-weight, and gaps are also allowed for between each rigid intermediate component and said cone.

It can be seen that, in accordance with the invention, the pre-stressing exercised by said rod which tends to pull said cone and said counter-weight together, causes a compressional pre-stressing of said first and second stacks and said intermediate stacks 8A, 8B, 8C and 8D, and causes a tractional stress on said rigid intermediate components.

Figure 3:
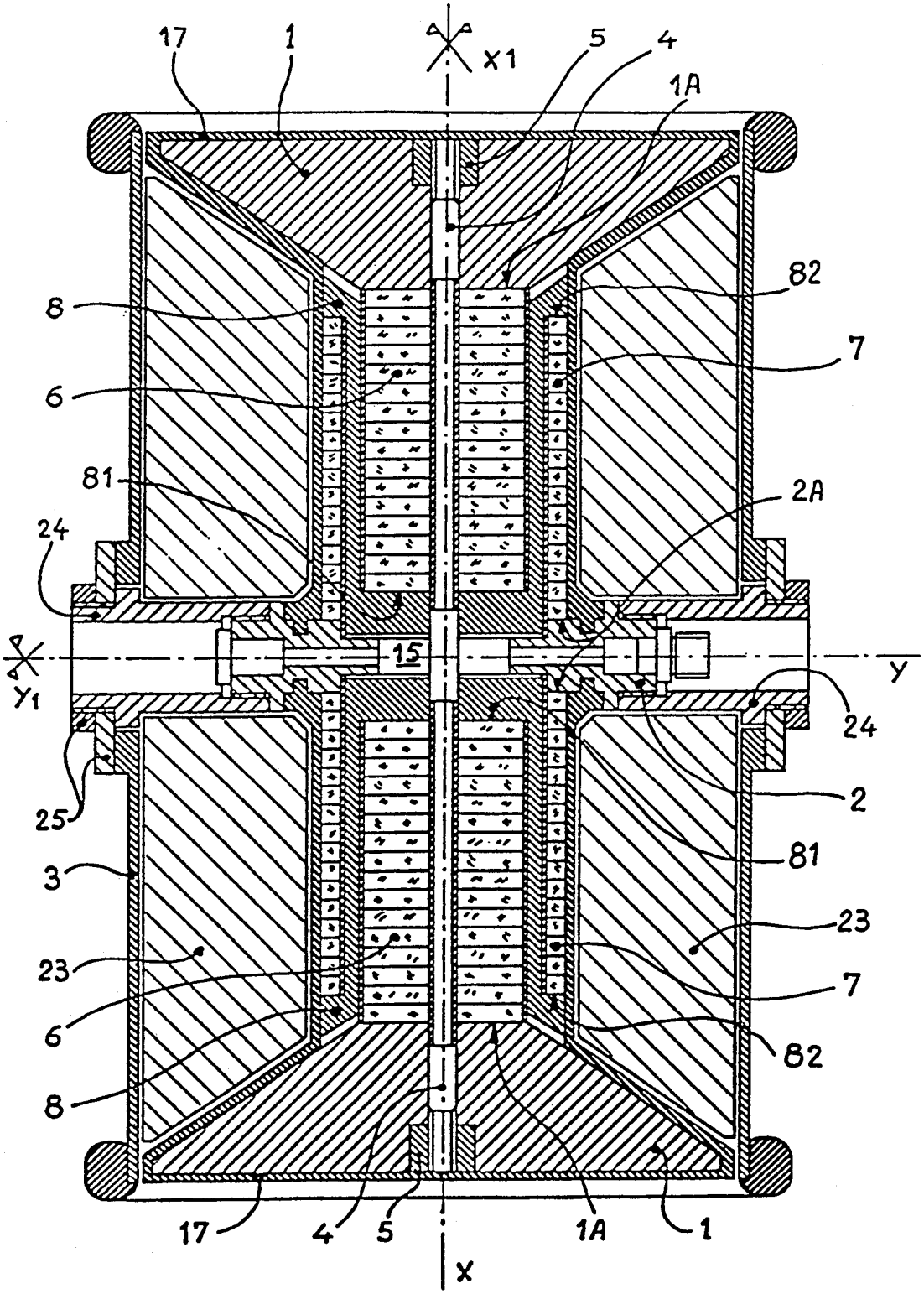
FIG. 3 represents a transverse section at reduced scale of a method of constructing a "JANUS" type electro-acoustic transducer, according to the invention.

A transverse section of means of constructing an electro-acoustic transducer according to the invention is shown in FIG. 3, in the form of a "JANUS" type assembly.

It can be seen on this figure, that in a known manner in this type of electro-acoustic transducer construction, the casing 3 is generally cylindrical along the longitudinal axis xx1 and is not hermetically sealed; within said casing two cones are arranged symmetrically in relation to the transverse axis yy1, cutting said electro-acoustic transducer in its middle, these cones 1 being linked by a pre-stressing rod 4, equipped with threading at both ends onto which are screwed two locking nuts 5, which are in contact with said cones; also arranged within said casing symmetrically around said axis yy1 are two first ceramic stacks 6, two rigid intermediate components 8 and two second ceramic stacks 7.

In this type of assembly, the central counter-weight 2 is usually smaller and lighter in comparison with the assemblies in FIGS. 1 and 2, and said rod 4 tends to pull said cones together and also tend to pull the two ceramic stacks 6, the two rigid intermediate components and the two second ceramic stacks 7 closer together.

It should be noted that in this type of construction, the rod 4 passes through the counter-weight, but is not rigidly connected to it.

The counter-weight, which can be disc-shaped, has two parallel contact faces 2A.

It can be seen from the figure that, in accordance with the invention, each of the cones is in contact over at least part of its face 1A with the first end of the first piezo-electric ceramic stack, which can be disc-shaped, this first stack being in contact at its second end with a first contact face 81, situated at the base of a rigid intermediate component 8, which can be cup-shaped and which has at its second end a second contact face 82, which is parallel to said first contact face 81; this rigid intermediate component is in contact by said contact face 82 with the first end of the second piezo-electric ceramic stack 7, which is in contact at its second end with the contact face 2A of said central counter-weight.

It can be seen that this so-called "JANUS" type construction basically consists of two "TONPILZ" constructions as described in FIG. 1 and 2, placed symmetrically around a transverse axis yy1, and with a shared counter-weight.

In the type of construction illustrated in FIG. 3, said piezo-electric ceramic stacks situated on the same side of said transverse axis yy1 are made to vibrate in phase, and said piezo-electric ceramic stacks on the other side of said transverse axis yy1 are made to vibrate with their phase shifted by 180°.

It can be seen on the figure, that in a way that is known in this type of assembly, the elastic covering 17 which covers said cones 1, also covers said piezo-electric ceramic stacks.

In this type of construction, the assembly consisting of said cones, said stacks and said counter-weight, covered by said elastic covering 17, is introduced into said casing and fixed in this by components 24 and 25—generally in the form of tubes—and with clamps.

It can also be seen that the cavity 15 allowing the passage of supply wires for said ceramics from them to the supply connector is situated within said counter-weight.

In a way that is known, this type of construction contains baffles 23, generally made out of honeycomb material, which fill most of the space between said elastic covering and the walls of said casing.

Figure 4:
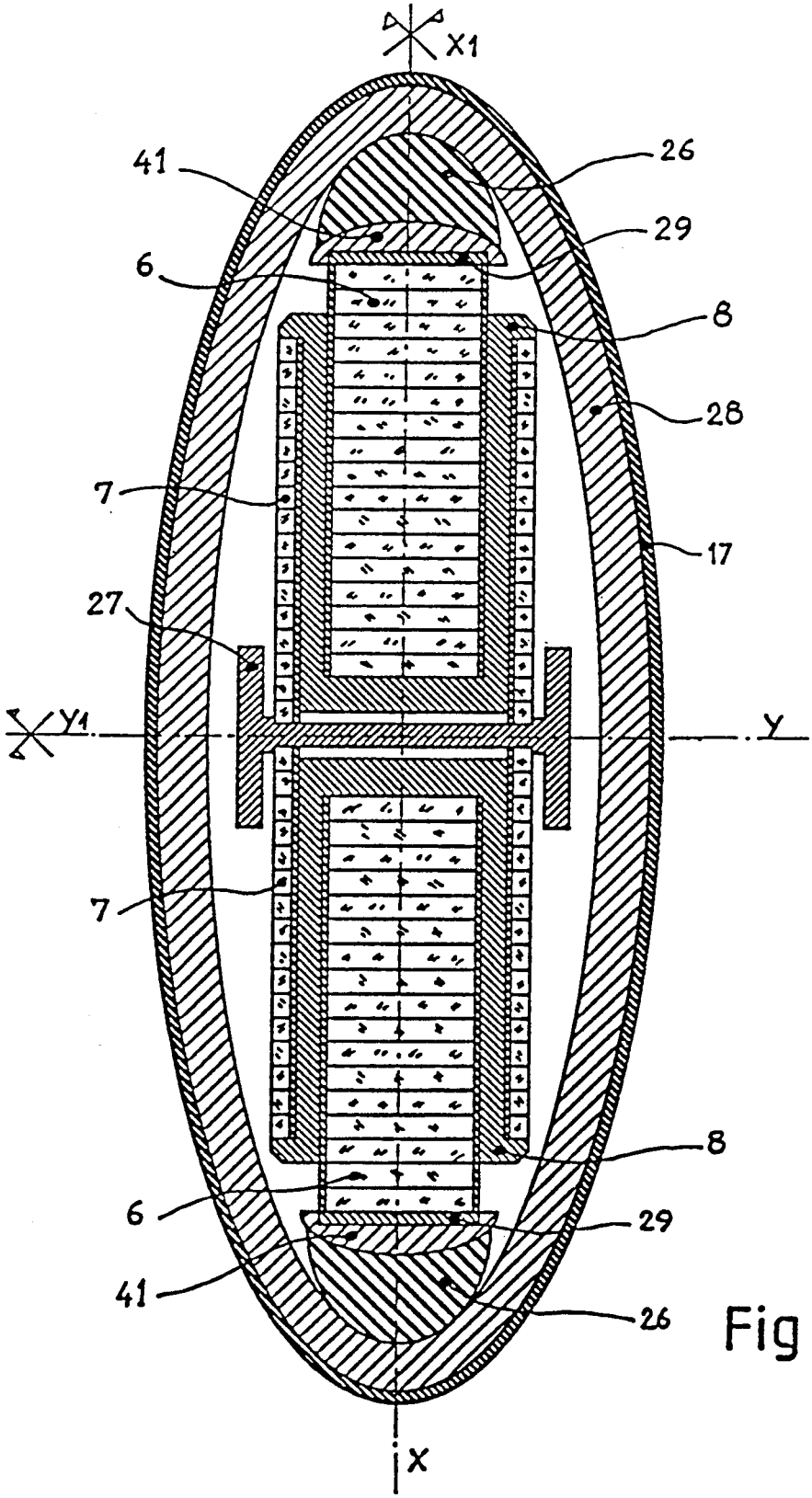
FIG. 4 represents a transverse section at reduced scale of a method of constructing a "FLEXTENSIONAL" type electro-acoustic transducer, according to the invention.

A transverse section of a means of constructing an electro-acoustic transducer according to the invention is shown in FIG. 4, in the form of a "FLEXTENSIONAL" type assembly.

The type of construction shown is more particularly that called the class 4 "FLEXTENSIONAL".

In this type of construction, the casing of said electro-acoustic transducer is made up by a shell 28, generally in fibre glass-epoxy composite, in the form of a cylinder whose axis is at right angles to the plane of FIG. 4, and of elliptical cross-section whose minor axis is along the transverse axis yy1 and whose major axis is along the longitudinal axis xx1.

said supporting components in this type of construction usually consist of a central core 27 and two inserts 26, which extend along an axis at right angles to the plane of the figure; in a way that is known, stacks of ceramics are arranged on either side of the transverse axis yy1, these stacks being elongated and have one of their ends connected to said inserts, preferably by means of an intermediate channel 41 and filler plate 29, and the other end is in contact with said core; pre-stressing is carried out in this type of construction by the shell itself which during assembly is pinched along its transverse axis yy1, so that the unit consisting of said channels and filler plates, said stacks and said core can be fitted into the inside; the pinching is then relaxed, which tends to release said cylindrical shell along said longitudinal axis xx1 and thus pre-stresses said ceramic stacks.

It can be seen on the figure, in accordance with the invention, that a rigid intermediate component 8, which transmits the pre-stressing between said first and second stacks, is interposed on either side of said core between the first ceramic stack 6 and the second ceramic stack 7 which is parallel to it.

It can be seen that an elastic waterproofing covering 17 encircles said shell.

The overall method of functioning of these electro-acoustic transducers is almost identical to that of the construction in FIG. 3, except for the principle of pre-stressing by means of the shell explained above, and the principle of transmitting the vibrations to the propagation medium. In the construction in FIG. 4, said elliptical cross-section shell is used as an amplifier of the vibratory movements of the inserts produced by said stacks; said vibratory movements of the inserts along the longitudinal axis xx1 cause vibratory movements of a greater amplitude to the parts of the shell extending on either side of these inserts, which movements are then transmitted to the exterior propagation medium.

Figure 5:
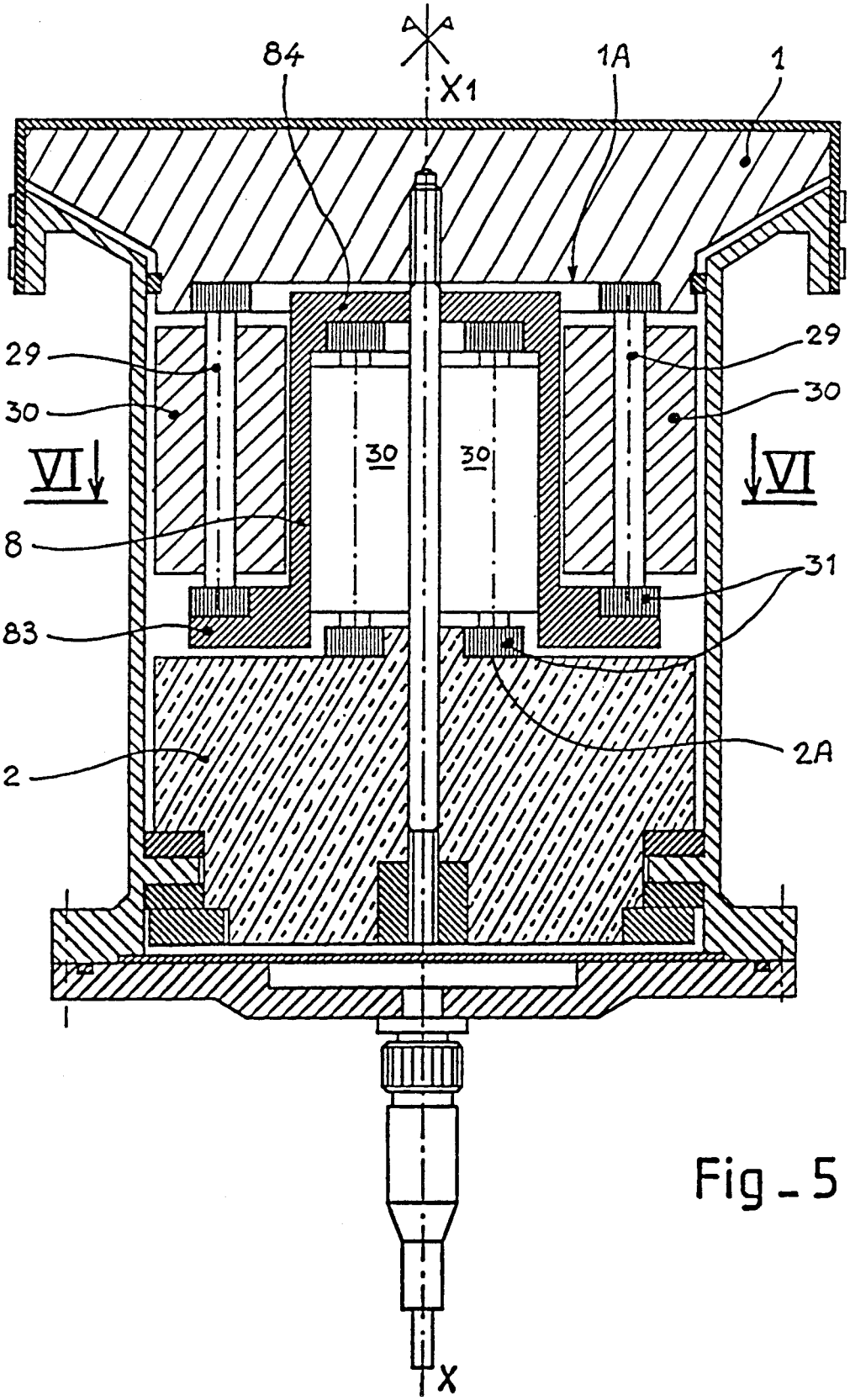
FIG. 5 represents a transverse sectional view at reduced scale of a method of constructing according to the invention a "TONPILZ" type electro-acoustic transducer equipped with magnetostrictive transducer units.

A transverse section of a means of constructing an electro-acoustic transducer according to the invention is shown in FIG. 5, in the form of a "TONPILZ" type assembly, equipped with magnetostrictive units.

Figure 6:
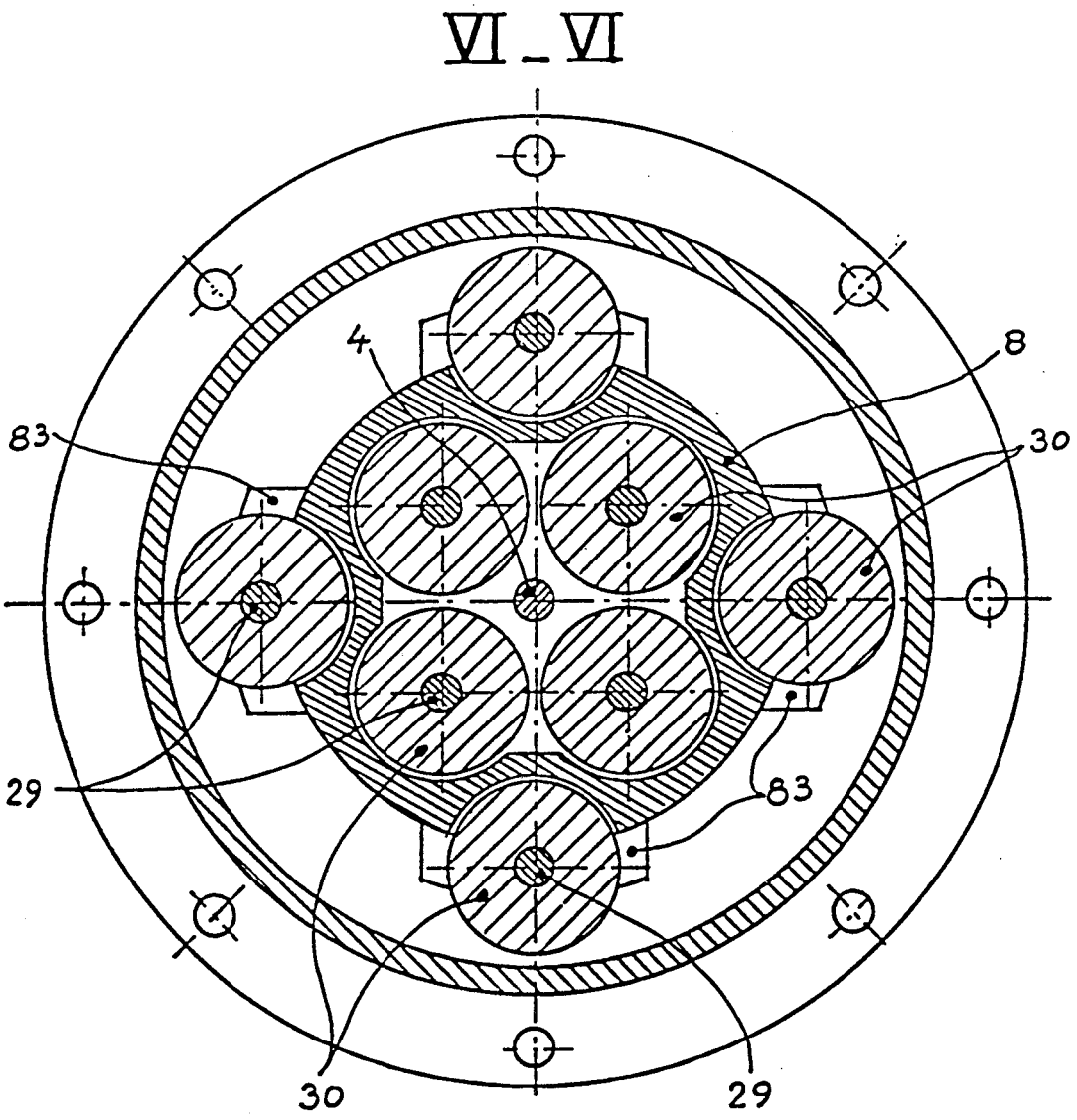
FIG. 6 is a section along VI—VI of FIG. 5.

A section VI—VI of FIG. 5 is represented in FIG. 6.

In these figures, said transducer units are made up of 29 magnetostrictive bars, which vibrate along their longitudinal axis parallel to axis xx1, when subjected to an magnetic field produced by the coils 30.

The bars situated in the same circle of axis xx1 are linked magnetically together by magnetic rings 31 which are not shown on FIG. 6.

On these figures it can be seen that the first transducer unit is made up of the first four bars situated outside the rigid intermediate component 8; these first four bars being in contact at their first end on the contact face 1A of the cone 1 by means of a ring 31, and by their second end by means of a ring 31 to the first contact face of said rigid intermediate component, which in this type of construction consists of four feet 83.

It can be seen that a second transducer unit is made up of four bars situated inside the rigid intermediate component 8, these four bars being in contact by their first end via a ring 31 with the contact face 2A of the counter-weight 2 and by their second end and/or by via a second ring 31 to a second contact face of said rigid intermediate component 8, which consists of the base 84, which is itself crossed by the pre-stressing rod 4.

It can be seen on FIG. 6 that said rigid intermediate component has a complex ring-shaped cross-section on its central tubular part whose outside perimeter fits neatly to the contours of the coils 30 of said first four bars and whose inside edge fits the contour of the coils 30 of said second four bars.

The technical field of the invention is that of submersible electro-acoustic transducers.

I claim:

1. An electro-acoustic transducer enclosed in a case containing first and second spaced apart supporting components and first and second transducer units of elongated shape along parallel longitudinal axes, means for compressively stressing said transducer units between said first and second support components along said longitudinal axes, and a rigid intermediate unit disposed between said transducer units, said transducer units having longitudinally spaced apart first and second ends, only the first end of said first transducer unit being in contact with said first supporting component, only the first end of said second transducer unit being in contact with said second supporting component, and said rigid intermediate unit having two longitudinal spaced apart faces which are in contact respectively with the second ends of said transducer units and co-axial therewith.

2. An electro-acoustic transducer according to claim 1 wherein said first and second transducer units respectively comprise a first stack of piezo-electric ceramics alternating with electrodes forming an elongated cylinder, and a second stack of piezo-electric ceramics alternating with electrodes forming a ring encircling said first transducer unit and co-axial therewith.

3. An electro-acoustic transducer according to claim 1 wherein each of said transducer units comprises a magnetostrictive bar.

4. An electro-acoustic transducer according to claim 1 including longitudinal gaps (9A, 9B) between said rigid intermediate unit and said first and second supporting components for preventing contacting of said rigid intermediate unit with said supporting components.

5. An electro-acoustic transducer according to claim 1 wherein said rigid intermediate unit is made up of a single component.

6. An electro-acoustic transducer according to claim 2 wherein said rigid intermediate unit is made up of a single component.

7. An electro-acoustic transducer according to claim 1 wherein said rigid intermediate unit is made up of two components and one of said transducer units is interposed between said two components.

8. An electro-acoustic transducer according to claim 2 wherein said rigid intermediate unit is made up of two components, and said transducer unit is interposed between said two components.

9. An electro-acoustic transducer according to claim 1 wherein said rigid intermediate component comprises a hollow cylindrical member having a longitudinal axis parallel to said longitudinal axes, one end of said member having an internal collar which contains one of said faces, which is in contact with the second end of said first transducer unit, and the other end of said member having an external collar which contains the other of said two faces, which is in contact with the second end of the second of said transducer units.

10. An electro-acoustic transducer according to calm 2 wherein said rigid intermediate component comprises a hollow cylindrical member co-axial with said transducer units, one end of said member having an internal collar which contains one of said parallel faces, which is in contact with the second end of said first transducer unit, and the other end of said member having an external collar which contains the other of said two faces, which is in contact with the second end of the second of said transducer units.

11. An electro-acoustic transducer according to claim 1 wherein each of said transducer units comprises an electrically deformable element, the cross-sectional area of the deformable elements of said first and second units being generally equal.

12. An electro-acoustic transducer according to claim 2 wherein the cross-sectional areas of the ceramics of said first and second units are generally equal.

13. An electro-acoustic transducer according to claim 1 in which each of said transducer units includes a plurality of electrically deformable elements stacked along said longitudinal axes, the longitudinally extending lengths of said elements of said first and second units being generally equal.

14. An electro-acoustic transducer according to claim 2 in which the longitudinally extending lengths of said ceramics of said first and second units are generally equal.

15. A method of assembling an electro-acoustic transducer comprising disposing one end of an elongated first transducer unit against a first supporting component, telescoping a hollow, elongated intermediate component around said first unit from the other end thereof until an inwardly projecting surface near one end of said intermediate component engages said other end of said first unit, telescoping a hollow, elongated second transducer around said intermediate component until one end of said second unit engages an outwardly extending surface at the other end of said intermediate component, engaging a second supporting component with the other end of said second unit, and clamping said first and second supporting components together for compressively stressing said first and second transducer units and said intermediate member.

* * * * *

UNITED STATES PATENT AND TRADEMARK OFFICE

CERTIFICATE OF CORRECTION

PATENT NO. : 5,130,953

DATED : July 14, 1992

INVENTOR(S) : Gilles Grosso

It is certified that error appears in the above-identified patent and that said Letters Patent is hereby corrected as shown below:

On title page add --[30] Foreign Application Priority Data June 12, 1990 [FR] France 90/07.552 --

Signed and Sealed this

Twenty-sixth Day of April, 1994

Bruce Lehman

*Attest:*

BRUCE LEHMAN

*Attesting Officer*

*Commissioner of Patents and Trademarks*